US011335314B2

(12) United States Patent
Tachi et al.

(10) Patent No.: US 11,335,314 B2
(45) Date of Patent: May 17, 2022

(54) ACTIVE NOISE CONTROL SYSTEM COMPRISING AUXILIARY FILTER SELECTION BASED ON OBJECT POSITION

(71) Applicant: ALPINE ELECTRONICS, INC., Tokyo (JP)

(72) Inventors: Ryosuke Tachi, Iwaki (JP); Yoshinobu Kajikawa, Suita (JP)

(73) Assignees: ALPINE ELECTRONICS, INC., Tokyo (JP); A SCHOOL CORPORATION KANSAI UNIVERSITY, Osaka (JP)

( * ) Notice: Subject to any disclaimer, the term of this patent is extended or adjusted under 35 U.S.C. 154(b) by 0 days.

(21) Appl. No.: 16/880,145

(22) Filed: May 21, 2020

(65) Prior Publication Data

US 2020/0372892 A1 Nov. 26, 2020

(30) Foreign Application Priority Data

May 22, 2019 (JP) ..... JP2019-096415

(51) Int. Cl.
*G10K 11/16* (2006.01)
*G10K 11/178* (2006.01)

(52) U.S. Cl.
CPC ..... *G10K 11/17854* (2018.01); *G10K 2210/1282* (2013.01); *G10K 2210/3028* (2013.01)

(58) Field of Classification Search
CPC ..... G10K 11/17854; G10K 2210/1282; G10K 2210/3028
USPC ..... 381/71.4, 71.6, 71.8, 71.12, 86
See application file for complete search history.

(56) References Cited

U.S. PATENT DOCUMENTS 5,267,320 A * 11/1993 Fukumizu ..... G10K 11/17854 381/71.12
10,699,691 B1 * 6/2020 Ye ..... G02B 27/017
2008/0273716 A1 * 11/2008 Saito ..... H04M 9/082 381/93
2009/0097679 A1 4/2009 Maeda
2010/0027805 A1 2/2010 Itou
2011/0044460 A1 * 2/2011 Rung ..... G10L 21/0208 381/58

(Continued)

FOREIGN PATENT DOCUMENTS

EP 3 441 965 2/2019
JP 2018-072770 5/2018

OTHER PUBLICATIONS

Extended European Search Report for 20175756.4 dated Oct. 16, 2020, 9 pgs.

*Primary Examiner* — Katherine A Faley
(74) *Attorney, Agent, or Firm* — Crowell & Moring LLP

(57) ABSTRACT

Adaptive filters output a cancellation sound from a speaker, a selector selects outputs of a plurality of auxiliary filters each corresponding to different positions, a subtractor subtracts the selected output from the output of the microphone and outputs the subtracted output to the adaptive filter as an error signal, and a position detection device detects a position of a head of a user. A transfer function estimated so that the error signal becomes 0 when noise is canceled at the corresponding position is preset in the auxiliary filter. When the auxiliary filter corresponding to the position close to the head of the user changes, the switching control unit stepwise increases the frequency with which the output of the auxiliary filter is selected by the selector to 100%.

17 Claims, 12 Drawing Sheets

(56) References Cited

U.S. PATENT DOCUMENTS

| | | | |
|---|---|---|---|
| 2014/0112490 | A1 | 4/2014 | Caillet et al. |
| 2019/0035380 | A1 | 1/2019 | Zafeiropoulos |

* cited by examiner

FIG. 8B1
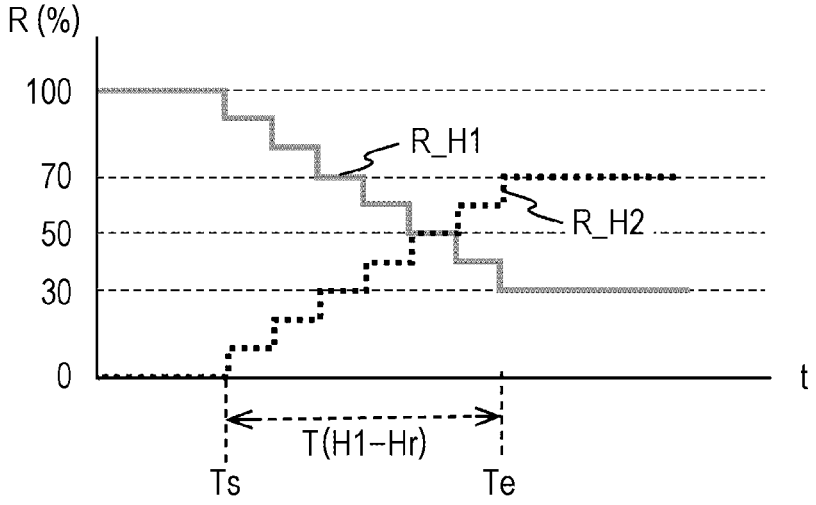
FIG. 8B2
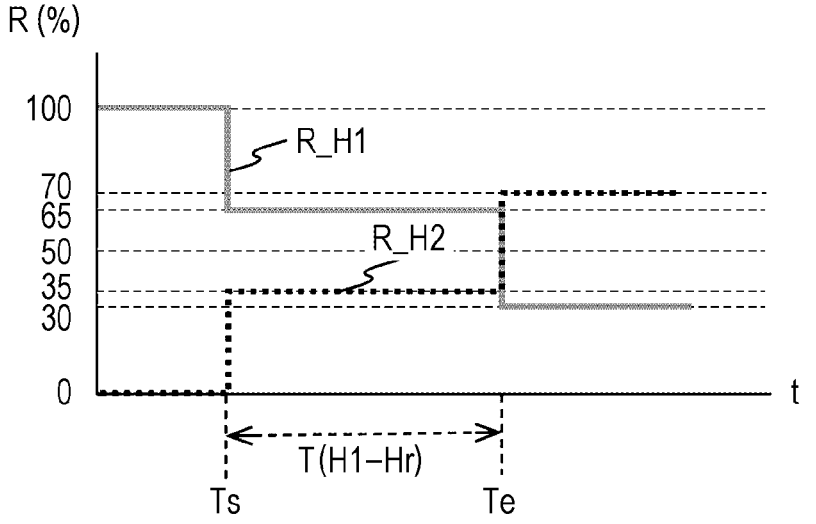

ACTIVE NOISE CONTROL SYSTEM COMPRISING AUXILIARY FILTER SELECTION BASED ON OBJECT POSITION

RELATED APPLICATION

The present application claims priority to Japanese Patent Application Number 2019-096415, filed May 22, 2019, the entirety of which is hereby incorporated by reference.

BACKGROUND

1. Field of the Invention

The present invention relates to a technology of active noise control (ANC) that reduces noise by radiating noise cancellation sound by which the noise is canceled.

2. Description of the Related Art

As a technology of active noise control that reduces noise by radiating noise cancellation sound by which noise is canceled, a technology is known in which a microphone and a speaker that are arranged near a noise cancellation position and an adaptive filter that generates the noise cancellation sound output from the speaker in an output signal of a noise source or a signal simulating the output signal are provided, and the adaptive filter adaptively sets a transfer function using, as an error signal, a signal obtained by correcting an output of a microphone using an auxiliary filter.

In this technology, a transfer function learned in advance which corrects a difference between a transfer function from a noise source to a noise cancellation position and a transfer function from the noise source to the microphone and a difference between a transfer function from the speaker to the noise cancellation position and a transfer function from the speaker to the microphone is preset in the auxiliary filter, and the auxiliary filter is used to cancel noise at the noise cancellation position different from a position of the microphone.

In addition, a technology is known in which a set of the microphone, the speaker, the adaptive filter, and the auxiliary filter corresponding to each of the two noise cancellation positions is provided, and outputs the noise cancellation sound from which noise is canceled at the corresponding noise cancellation position in each set by using the above-described technology to cancel the noise generated from the noise source at two noise cancellation positions, respectively (for example, JP 2018-72770 A).

In the case of canceling noise heard by a user by using the technology for canceling the noise at the noise cancellation position different from the position of the microphone using the above-mentioned auxiliary filter, if a head of a user shifts from the noise cancellation position along with the displacement of the user, the noise heard by the user may not be canceled satisfactorily.

Therefore, the transfer function of the auxiliary filter is learned for a plurality of different noise cancellation positions, and the transfer function of the auxiliary filter is switched to the learned transfer function for the noise cancellation position corresponding to the position of the head of the user along with the displacement of the head of the user, and as a result, it is conceivable to cancel the noise heard by the user regardless of the displacement of the head of the user.

However, in this case, when the transfer function of the auxiliary filter is switched, problems such as divergence of the adaptive filter and generation of noise in the noise cancellation sound may occur.

SUMMARY

Therefore, an object of the present disclosure is to provide an active noise control system that switches characteristics without hindrance according to a displacement of a target whose noise needs to be canceled so as to cancel the noise at the position after the displacement.

To address the problem, the present disclosure provides an active noise control system for reducing noise heard by an object, the active noise control system including: a microphone; an adaptive filter that uses a noise signal representing the noise as an input; a speaker that outputs an output of the adaptive filter as a noise cancellation sound; a plurality of auxiliary filters that use the noise signal as an input and are provided corresponding to a plurality of different positions; an error correction unit that corrects a microphone output signal, which is the output of the microphone, using the output of one of the auxiliary filters and outputs the corrected microphone output signal to the adaptive filter as an error signal; a position detection unit that detects a position of the object; and a switching control unit that performs a switching operation of switching a signal output as the error signal from the error correction unit to a signal obtained by correcting the microphone output signal using the output of the auxiliary filter after the switching by controlling the error correction unit using the auxiliary filter, in which the corresponding position matches the position of the object, as the auxiliary filter after the switching, when the auxiliary filter in which the corresponding position matches the position of the object detected by the position detection unit changes.

The adaptive filter executes a predetermined adaptive algorithm using an error indicated by an error signal input from the error correction unit and updates a transfer function of the adaptive filter. The transfer function learned as the transfer function in which the error indicated by the error signal becomes 0 is preset in the plurality of auxiliary filters when the noise is canceled by the noise cancellation sound at the corresponding position. The switching control unit gradually or stepwise decreases a ratio at which the signal obtained by correcting the microphone output signal using the output of the auxiliary filter before the switching at the switching operation is output as the error signal by using, as the auxiliary filter before the switching, the auxiliary filter using the output for the correction of the microphone output signal before the switching operation to 0%, and gradually or stepwise increases a ratio at which the signal obtained by correcting the microphone output signal by using the output of the auxiliary filter after the switching is output as the error signal, or the decrement to 100%.

According to such an active noise control system, the auxiliary filter used to generate the error signal to input to the adaptive filter according to the change in the position of the object is switched to the auxiliary filter after the switching that is the auxiliary filter capable of satisfactorily canceling the noise at the position matching the position of the object, and as a result, it is possible to satisfactorily cancel the noise heard by the object regardless of the displacement of the object.

In addition, since the ratio at which the signal generated using the auxiliary filter after the switching is output as the error signal gradually or stepwise increases while the ratio at which the signal generated using the auxiliary filter before the switching is output as the error signal gradually or stepwise decreases, the switching can suppress the divergence of the adaptive filter or the occurrence of the noise of the noise cancellation sound.

In addition, the present disclosure provides an active noise control system for reducing noise heard by an object, the active noise control system including: a microphone; an adaptive filter that uses a noise signal representing the noise as an input; a speaker that outputs an output of the adaptive filter as a noise cancellation sound; a plurality of auxiliary filters that use the noise signal as an input and are provided corresponding to a plurality of different positions; an error correction unit that corrects a microphone output signal, which is the output of the microphone, using an output of one of the auxiliary filters and outputs the corrected microphone output signal to the adaptive filter as an error signal; a position detection unit that detects a position of the object; and a switching control unit that controls the error correction unit to output a signal obtained by correcting the microphone output signal using an output of a first mixture target auxiliary filter and a signal obtained by correcting the microphone output signal using an output of a second mixture target auxiliary filter as the error signal from the error correction unit at a ratio after switching which is a ratio determined according to a ratio of a distance between a position corresponding to the first mixture target auxiliary filter and a position of the object and a distance between a position corresponding to the second mixture target auxiliary filter and the position of the object, using, as the first mixture target auxiliary filter and the second mixture target auxiliary filter, two auxiliary filters in which two positions corresponding to the two auxiliary filters become the position of the object when the position of the object detected by the position detection unit changes. The adaptive filter executes a predetermined adaptive algorithm using an error indicated by an error signal input from the error correction unit and updates a transfer function of the adaptive filter. The transfer function learned as the transfer function in which the error indicated by the error signal becomes 0 is preset in the plurality of auxiliary filters when the noise is canceled by the noise cancellation sound at the corresponding position.

According to such an active noise control system, even if the position of the object is the position where an auxiliary filter capable of satisfactorily canceling the noise at the position is not prepared, it is possible to cancel the noise heard by the object by using the two auxiliary filters in which the position between the positions where the noise can be canceled satisfactorily is the position of the object.

Here, the active noise control system may be configured so that the switching control unit gradually or stepwise changes the ratio of the signal obtained by correcting the microphone output signal, which is output from the error correction unit as the error signal, using the output of the first mixture target auxiliary filter and the signal obtained by correcting the microphone output signal using the output of the second mixture target auxiliary filter to the ratio after the switching, in the switching operation.

Here, in the active noise control system, the object may be the head of the user who is seated on the seat that is displaceable within the predetermined range, and each position where the head of the human body seated on the seat at the positions is normally positioned may be the positions corresponding to each of the plurality of auxiliary filters, each position of the plurality of different seat positions within the displacement range being obtained.

Further, the present disclosure also provides an active noise control system that includes two systems of a first system and a second system including a microphone, an adaptive filter, a speaker, a plurality of auxiliary filters, and an error correction unit. The plurality of auxiliary filters of the first system and the plurality of auxiliary filters of the second system are associated in a one-to-one correspondence, and a position relationship between a position corresponding to the auxiliary filter of the first system and a position corresponding the auxiliary filter of the second system that are associated matches or approximates a position relationship of predetermined two positions fixed to the object. In addition, the adaptive filter of the first system and the adaptive filter of the second system execute a predetermined adaptive algorithm using an error signal output from the error correction unit of the first system and an error signal output from the error correction unit of the second system to update a transfer function of the adaptive filter. The learned transfer function as the transfer function in which the error signal output from the error correction unit of the first system and the error signal output from the error correction unit of the second system become 0 is preset in the plurality of auxiliary filters of the first system and the plurality of auxiliary filters of the second system when the noise is canceled by noise cancellation sounds output from the speaker of the first system and the speaker of the second system at the position corresponding to the auxiliary filter of the first system and the position corresponding to the auxiliary filter of the second system.

Here, in the active noise control system, the object may be the head of the user who is seated on the displaceable seat within the predetermined range, and each position where a left ear of the human body seated on the seat at the position may be normally positioned is a position corresponding to one of the plurality of auxiliary filters of the first system and each position where a right ear of the human body seated on the seat at the position may be a position corresponding to one of the plurality of auxiliary filters of the second system, each position of the plurality of different seat positions within the displacement range being obtained, and the plurality of auxiliary filters of the first system and the plurality of auxiliary filters of the second system that are associated may be the plurality of auxiliary filters of the first system and the plurality of auxiliary filters of the second system in which the position corresponding to the same seat position is obtained.

In addition, in the above active noise control system, the predetermined seat may be a seat of an automobile.

As described above, the present disclosure provides the active noise control system that switches the characteristics without hindrance according to the displacement of the target whose noise needs to be canceled so as to cancel the noise at the position after the displacement.

BRIEF DESCRIPTION OF THE DRAWINGS

FIGS. 8A, 8B1, and 8B2 are diagrams illustrating the switching operation of the auxiliary filter according to the embodiment of the present invention;

DETAILED DESCRIPTION

Figure 1:
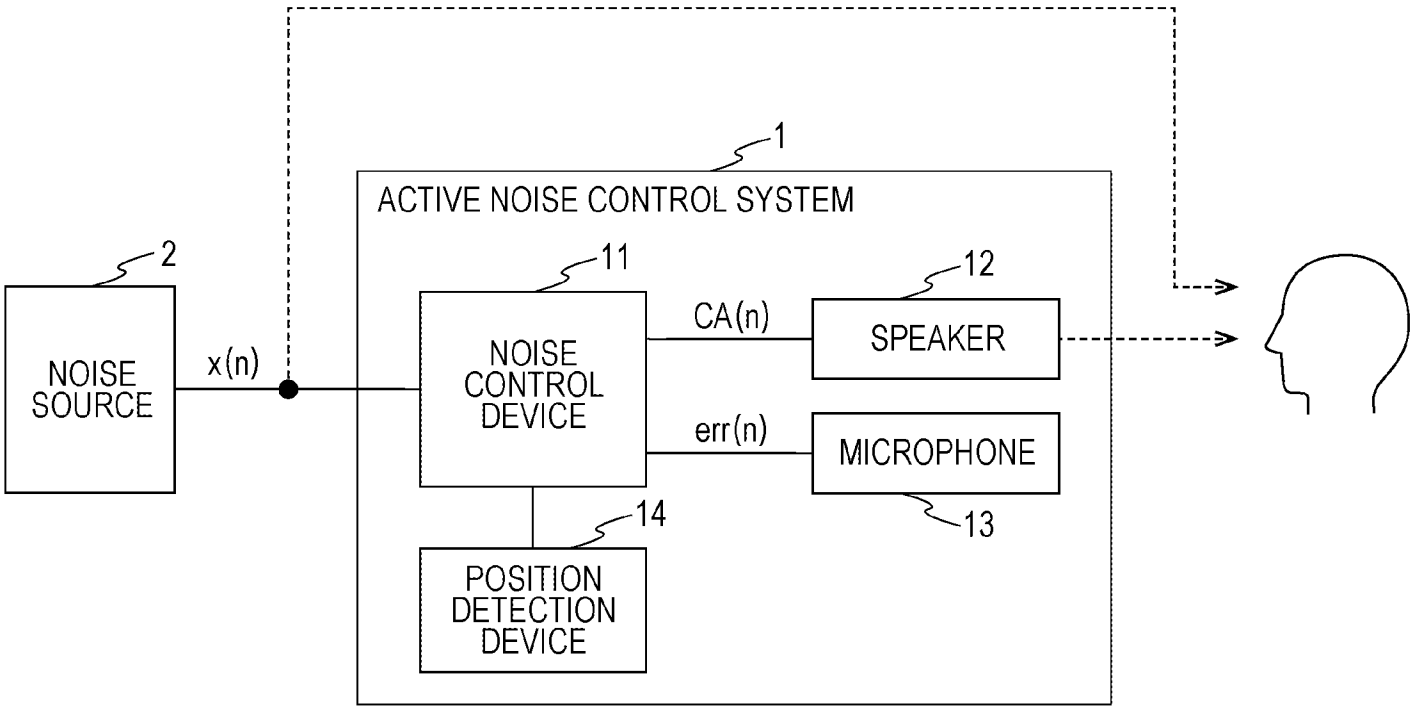
FIG. 1 is a block diagram illustrating a configuration of an active noise control system according to an embodiment of the present invention.

Hereinafter, embodiments of the present invention will be described. FIG. 1 illustrates a configuration of an active noise control system according to one embodiment. As illustrated, an active noise control system 1 includes a noise control device 11, a speaker 12, a microphone 13, and a position detection device 14. The active noise control system 1 is a system installed in an automobile, and is a system that cancels noise generated from a noise source 2 at a cancellation point, with the position of a head of a user who boards the automobile as the cancellation point.

Figure 2:
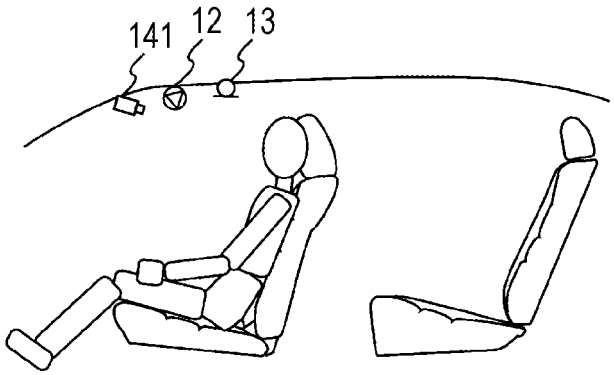
FIG. 2 is a diagram illustrating an arrangement of a speaker and a microphone of the active noise control system according to the embodiment of the present invention.

Further, as illustrated in FIG. 2, the speaker 12 and the microphone 13 are arranged, for example, on a ceiling in front of a target seat (right front seat in FIG. 2) that is a seat on which a user who is a target of noise cancellation in an automobile is seated.

In addition, the position detection device 14 is a device that detects the position of the head of the user, and includes a camera 141 that is provided in front of the target seat illustrated in FIG. 2 to photograph a periphery of the target seat or a sensor (not illustrated) that detects a position of the target seat in a front-back direction or an inclination of a backrest, and detects an image photographed by the camera 141 or the position of the head of the user from the position of the target seat or the inclination of the backrest that is detected by the sensor.

Returning to FIG. 1, the noise control device 11 of the active noise control system 1 uses a noise signal x (n) representing the noise generated from the noise source 2 and a microphone error signal err (n) which is a voice signal picked up by the microphone 13 to generate a cancel signal CA (n) that cancels the noise generated from the noise source 2 at the cancellation point and outputs the generated cancel signal CA (n) from the speaker 12.

Figure 3:
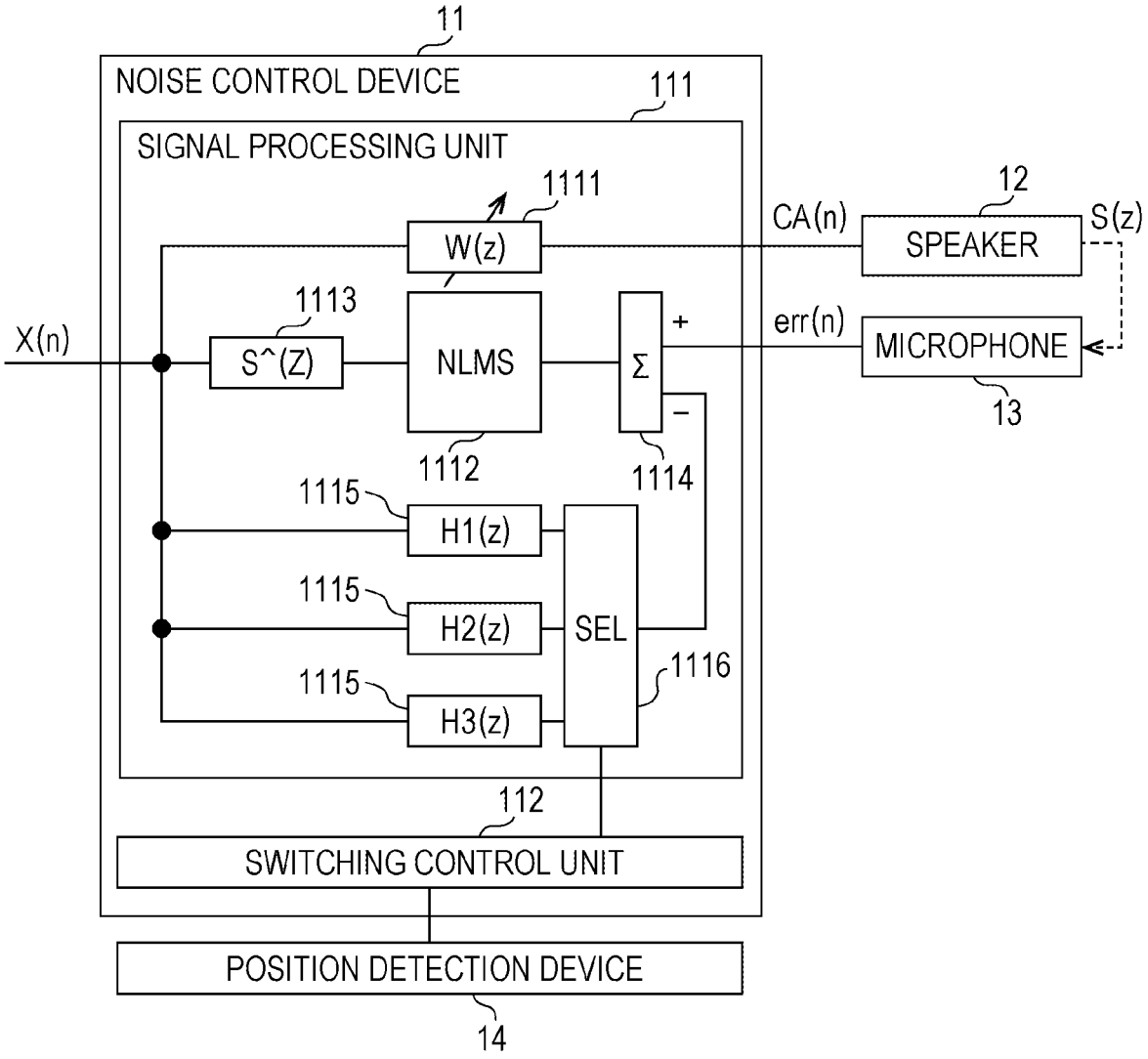
FIG. 3 is a block diagram illustrating a configuration of a noise control device according to the embodiment of the present invention.

Subsequently, FIG. 3 illustrates a configuration of the noise control device 11 of the active noise control system 1. As illustrated, the noise control device 11 includes a signal processing unit 111 and a switching control unit 112. The signal processing unit 111 includes a variable filter 1111, an adaptive algorithm execution unit 1112, an estimation filter 1113 for which a transfer function $\hat{S}(z)$ is preset, a subtractor 1114, three auxiliary filters 1115 for which transfer functions H1 (*z*), H2 (*z*), and H3 (*z*) are each preset, and a selector 1116 that selects and outputs one of outputs of the three auxiliary filters 1115 according to the control of the switching control unit 112.

In such a configuration of the signal processing unit 111, the input noise signal x (n) is output to the speaker 12 as the cancellation signal CA (n) through the variable filter 1111. In addition, the input noise signal x (n) is transmitted to the selector 1116 through each of the three auxiliary filters 1115, and the selector 1116 selects one of the outputs of the three auxiliary filters 1115 according to the control of the switching control unit 112 and transmits the selected output to the subtractor 1114. The subtractor 1114 subtracts and corrects the output of the selector 1116 from the microphone error signal err (n) picked up by the microphone 13, and outputs the corrected output to the adaptive algorithm execution unit 1112 as an error.

Subsequently, the variable filter 1111, the adaptive algorithm execution unit 1112, and the estimation filter 1113 configure a Filtered-X adaptive filter. An estimation transfer characteristic $\hat{S}(z)$ estimated by actual measurement of the transfer function S (z) from the signal processing unit 111 to the microphone 13 is preset in the estimation filter 1113, and the estimation filter 1113 convoluted the transfer characteristic $\hat{S}(z)$ with the input noise signal x (n) and outputs the convoluted transfer characteristic $\hat{S}(z)$ to the adaptive algorithm execution unit 1112.

Then, the adaptive algorithm execution unit 1112 receives the noise signal x (n) with which the transfer function $\hat{S}(z)$ is convoluted by the estimation filter 1113 and the error output from the subtractor 1114 as an input, and executes the adaptive algorithm by NLMS to update a transfer function W (z) of the variable filter 1111 so that the error becomes 0.

Subsequently, first stage learning processing and second stage learning processing are performed on each of the transfer functions H1 (*z*), H2 (*z*), and H3 (*z*) of each auxiliary filter 1115 of the signal processing unit 111, and thus the transfer functions H1 (*z*), H2 (*z*), and H3 (*z*) are set.

Figure 4A:
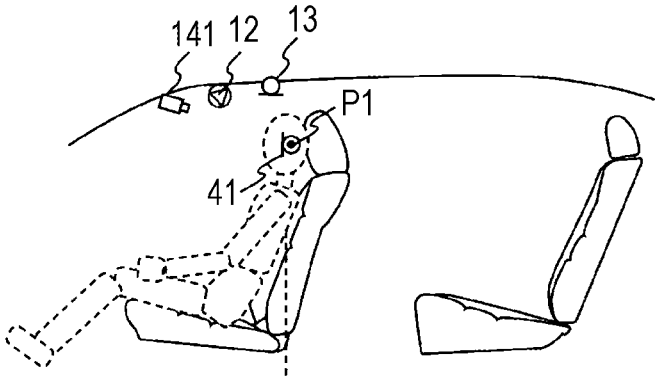
FIGS. 4A to 4C are diagrams illustrating arrangement examples of a learning microphone according to the embodiment of the present invention.
Figure 4B:
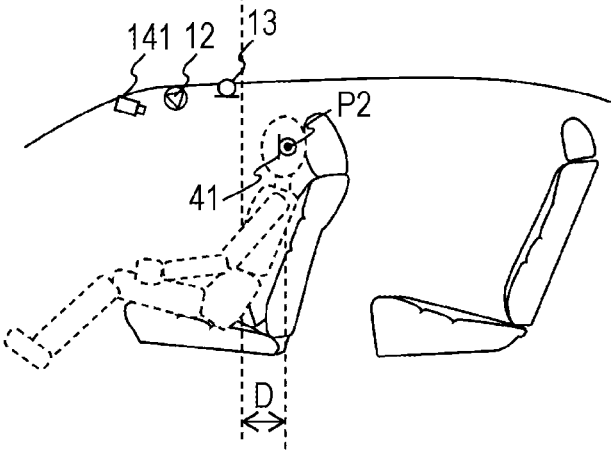
Figure 4C:
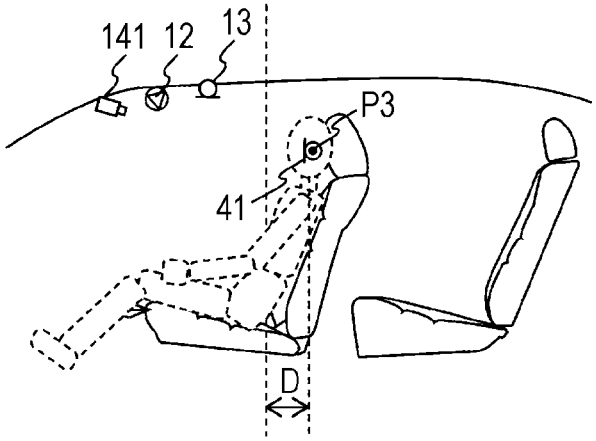

Here, each of the transfer functions H1 (*z*), H2 (*z*), and H3 (*z*) of the three auxiliary filters 1115 corresponds to different cancellation points. That is, the transfer function H1 (*z*) corresponds to a cancellation point P1 that is a typical position of the head of a user when the position of the target seat is set to a position that is ahead of a standard position in the front-back direction by a distance D as illustrated in FIG. 4A, the transfer function H2 (*z*) corresponds to a cancellation point P2 that is the typical position of the head of the user when the position of the target seat is set to the standard position in the front-back direction as illustrated in FIG. 4B, and the transfer function H3 (*z*) corresponds to a cancellation point P3 that is the typical position of the head of the user when the position of the target seat is set to a position that is behind the standard position in the front-back direction by the distance D as illustrated in FIG. 4C.

Figure 5A:
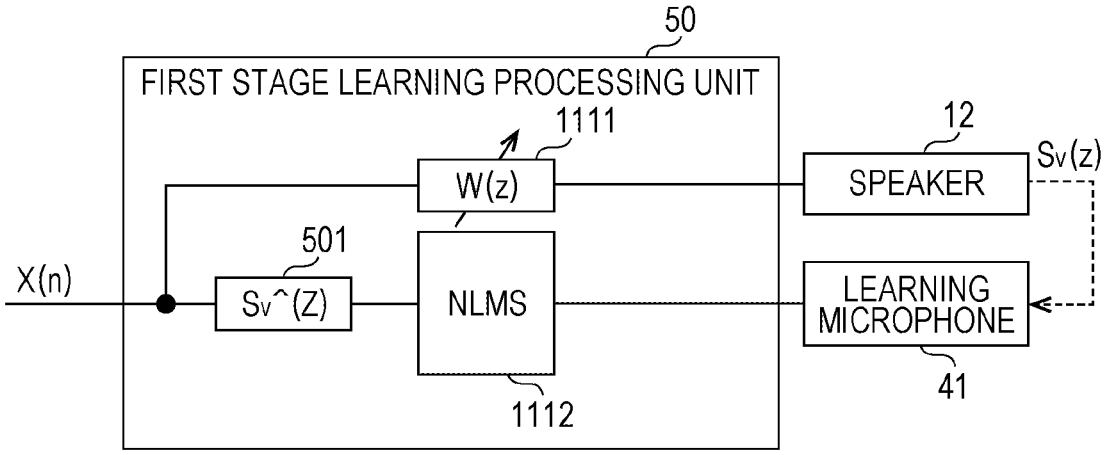
FIGS. 5A and 5B are block diagrams illustrating a configuration of learning of a transfer function of an auxiliary filter according to the embodiment of the present invention.

The first stage learning processing is performed in a configuration in which the first signal processing unit is replaced with a first stage learning processing unit 50 illustrated in FIG. 5A and the microphone 13 is replaced with the learning microphone 41. Assuming i is an arbitrary number among 1, 2, and 3, when learning a transfer function Hi (z), the learning microphone 41 is arranged at a cancellation point Pi as illustrated in FIGS. 4A, 4B, and 4C. That is, when learning the transfer function H1 (*z*), the learning microphone 41 is arranged at the cancellation point P1 as illustrated in FIG. 4A, when learning the transfer function H2 (*z*), the learning microphone 41 is arranged at the cancellation point P2 as illustrated in FIG. 4B, and when learning the transfer function H3 (z), the learning microphone 41 is arranged at the cancellation point P3 as illustrated in FIG. 4C.

The first stage learning processing unit 50 illustrated in FIG. 5A has a configuration in which the three auxiliary filters 1115, the selector 1116, and the subtractor 1114 are removed from the signal processing unit 111 illustrated in FIG. 3, the estimation filter 1113 is replaced with the first stage learning estimation filter 501 for which the transfer function $S_v\hat{}(z)$ is set, and the output of the learning microphone 41 is input to the adaptive algorithm execution unit 1112 as an error. However, the transfer function $S_v\hat{}(z)$ represents the transfer function from the first stage learning processing unit 50 to the learning microphone 41.

Then, in such a configuration, the transfer function W (z) of the variable filter 1111 is converged and stabilized by the adaptive operation by the adaptive algorithm execution unit 1112, and the converged and stabilized transfer function W (z) is obtained as the result of the first stage learning processing.

Figure 5B:
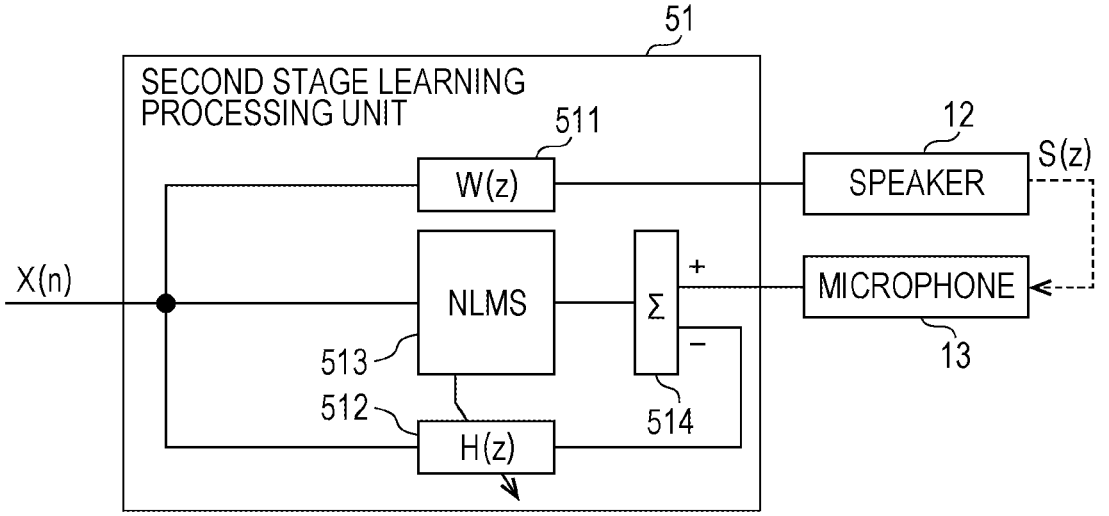

Subsequently, the second stage learning processing is set in a configuration in which the signal processing unit 111 of FIG. 3 is replaced with the second stage learning processing unit 51 illustrated in FIG. 5B. The second stage learning processing unit 51 illustrated in FIG. 5B includes a second stage learning fixed filter 511 for which the transfer function W (z) obtained as a result of the first stage learning processing is set as the transfer function, a second stage learning variable filter 512, a second stage learning adaptive algorithm execution unit 513, and a second stage learning subtractor 514.

The noise signal x (n) input to the second stage learning processing unit 51 is output to the speaker 12 through the second stage learning fixed filter 511. Further, the input noise signal x (n) is transmitted to the second stage learning subtractor 514 through the second stage learning variable filter 512, and the second stage learning subtractor 514 subtracts the output of the second stage learning variable filter 512 from the signal picked up by the microphone 13 and outputs the subtracted output to the second stage learning adaptive algorithm execution unit 513 as an error.

Then, in such a configuration, the transfer function H (z) of the second stage learning variable filter 512 is converged and stabilized by the adaptive operation by the second stage learning adaptive algorithm execution unit 513, and the converged and stabilized transfer function H (z) is learned as a transfer function Hi (z) of an i-th auxiliary filter 1115.

Subsequently the switching operation performed by the switching control unit 112 of the noise control device 11 of FIG. 3 will be described. The switching control unit 112 switches the auxiliary filter 1115 that selects the output by the selector 1116 and transmits the selected output to the subtractor 1114 according to the position of the head of the user of the target seat detected by the position detection device 14.

This switching is performed by calculating a cancellation point closest to the position of the head detected by the position detection device 14 among the cancellation points P1, P2, and P3 of FIGS. 4A, 4B, and 4C, and causing the selector 1116 to switch the output transmitted to the subtractor 1114 to the output of the auxiliary filter 1115 for which a transfer function Hx (z) corresponding to the calculated cancellation point Px is set when the calculated cancellation point changes.

That is, among the cancellation points P1, P2, and P3 of FIGS. 4A, 4B, and 4C, when the cancellation point P1 is closest to the position of the head detected by the position detection device 14, the selector 1116 switches the output transmitted to the subtractor 1114 to the output of the auxiliary filter 1115 for which the transfer function H1 (z) is set, when the cancellation point P2 is closest to the position of the head detected by the position detection device 14, the selector 1116 switches the output transmitted to the subtractor 1114 to the output of the auxiliary filter 1115 for which the transfer function H2 (z) is set, and when the cancellation point P3 is closest to the position of the head detected by the position detection device 14, the selector 1116 switches the output transmitted to the subtractor 1114 to the output of the auxiliary filter 1115 for which the transfer function H3 (z) is set.

Figure 6A:
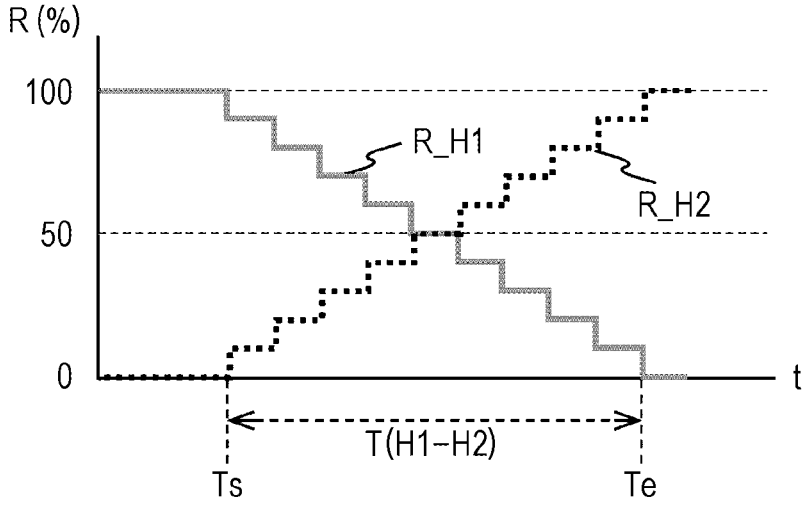
FIGS. 6A and 6B are diagrams illustrating a switching operation of the auxiliary filter according to the embodiment of the present invention.

In addition, this switching is performed so that the output transmitted from the selector 1116 to the subtractor 1114 stepwise changes from the output before the switching to the output after the switching. That is, for example, when the output before the switching transmitted from the selector 1116 to the subtractor 1114 is the output of the auxiliary filter 1115 for which the transfer function H1 (z) is set, and the output after the switching is the output of the auxiliary filter 1115 for which the transfer function H2 (z) is set, as illustrated in FIG. 6A, a ratio R_H1 of the output of auxiliary filter 1115 for which the transfer function H1 (z) input to the subtractor 1114 is set stepwise decreases from 100% to 0% during a transition time length T (H1-H2) from the preset transfer function H1 (z) to the transfer function H2 (z), a ratio R_H2 of the output of the auxiliary filter 1115 for which the transfer function H2 (z) input to the subtractor 1114 stepwise increases from 0% to 100% while satisfying R_H1+R_H2=100%, and the ratio R_H2 needs to be maintained at 100% after the lapse of T (H1-H2). In FIG. 6A, the ratio R_H1 decreases from 100% to 0% by 10% and the ratio R_H2 increases from 0% to 100% by 10% at predetermined time intervals.

Here, the ratio of the output of the auxiliary filter 1115 input to the subtractor 1114 is set by controlling a selection frequency of the output of the auxiliary filter 1115 before and after the switching of the selector 1116. That is, for example, when the output of the auxiliary filter 1115 for which the transfer function H1 (z) is set is 80% and the output of the auxiliary filter 1115 for which the transfer function H2 (z) is set is 20%, the selector 1116 repeats selecting the output value of the auxiliary filter 1115, for which transfer function H2 (z) is set, twice after selecting the output value of the auxiliary filter 1115, for which function H1 (z) is set, eight times. Similarly, when the output of the auxiliary filter 1115 for which transfer function H1 (z) is set is 50% and the output of the auxiliary filter 1115 for which transfer function H2 (z) is set is 50%, the selector 1116 alternately performs selecting the output value of the auxiliary filter 1115 for which the transfer function H1 (z) is set and selecting the output value of the auxiliary filter 1115 for which function H2 (z) is set.

In addition, the transition time length where the above-mentioned stepwise switching is performed may be set so that the larger the distance between cancellation points Pj and Pk corresponding to transfer functions Hj (z) and Hk (z) set in the auxiliary filter 1115 before and after the switching, the longer the transition time it takes. That is, for example, since the distance between the cancellation points P1 and P3 is larger than the distance between the cancellation points P1 and P2 or the distance between the cancellation points P2 and P3 in FIGS. 4A to 4C, the transition time length at the time of switching between the output of the auxiliary filter 1115 for which the transfer function H1 (z) is set and the output of the auxiliary filter 1115 for which the transfer function H3 (z) is set may be larger than the transition time length at the time of switching between the outputs of the auxiliary filter 1115 for which other transfer functions are set.

Figure 6B:
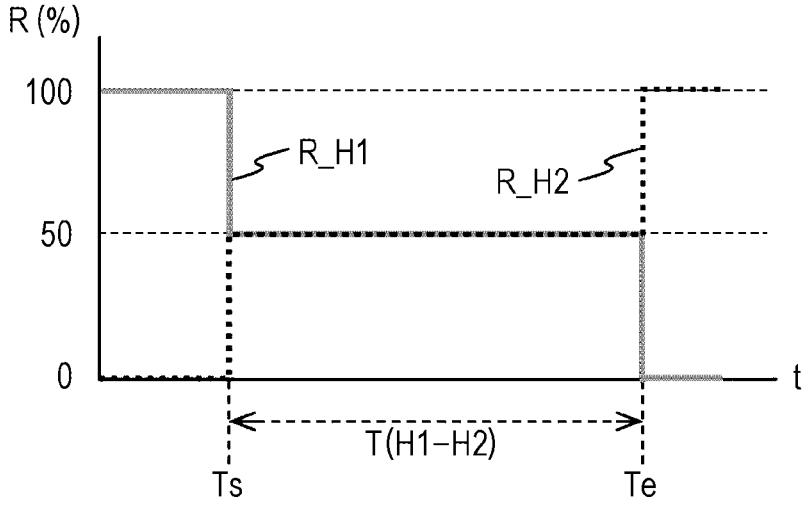

In addition, the number of steps of changing the ratio of the output before and after the switching of the output transmitted from the selector 1116 to the subtractor 1114 may be arbitrary, and for example, as illustrated in FIG. 6B, for the case of switching from the output of the auxiliary filter 1115 for which the transfer function H1 (z) is set to the output of the auxiliary filter 1115 for which the transfer function H2 (z) is set, the ratio R_H1 of the output of the auxiliary filter 1115 for which the transfer function H1 (z) input to the subtractor 1114 is set may decrease to 100%, 50%, and 0% during T (H1-H2) and the ratio R_H2 of the auxiliary filter 1115 for which the transfer function H2 (z) input to the subtractor 1114 is set may increase to 0%, 50%, and 100%.

According to the present embodiment as described above, the auxiliary filter 1115 used to generate the error signal input to the adaptive filter is switched to the auxiliary filter 1115 that can satisfactorily cancel the noise at the cancellation point close to the position of the head of the user, and therefore it is possible to satisfactorily cancel the noise heard by the user regardless of the displacement of the head of the user.

In addition, since the ratio at which the signal generated using the auxiliary filter 1115 after the switching is output as the error signal gradually or stepwise increases while the ratio at which the signal generated using the auxiliary filter 1115 before the switching is output as the error signal gradually or stepwise decreases, the switching can suppress the divergence of the adaptive filter or the occurrence of the noise of the noise cancellation sound.

However, in the above embodiment, the cancellation point P2 corresponding to the transfer function H2 (z) exists between the cancellation point P1 corresponding to the transfer function H1 (z) and the cancellation point P3 corresponding to the transfer function H3 (z), and since transfer function H2 (z) can be expected to be an intermediate value between transfer function H1 (z) and transfer function H3 (z), in the above embodiment, the switching between the output of the auxiliary filter 1115 for which transfer function H1 (z) is set and the output of the auxiliary filter 1115 for which the transfer function H3 (z) is set may be performed via the transfer function H2 (z).

Figure 7A:
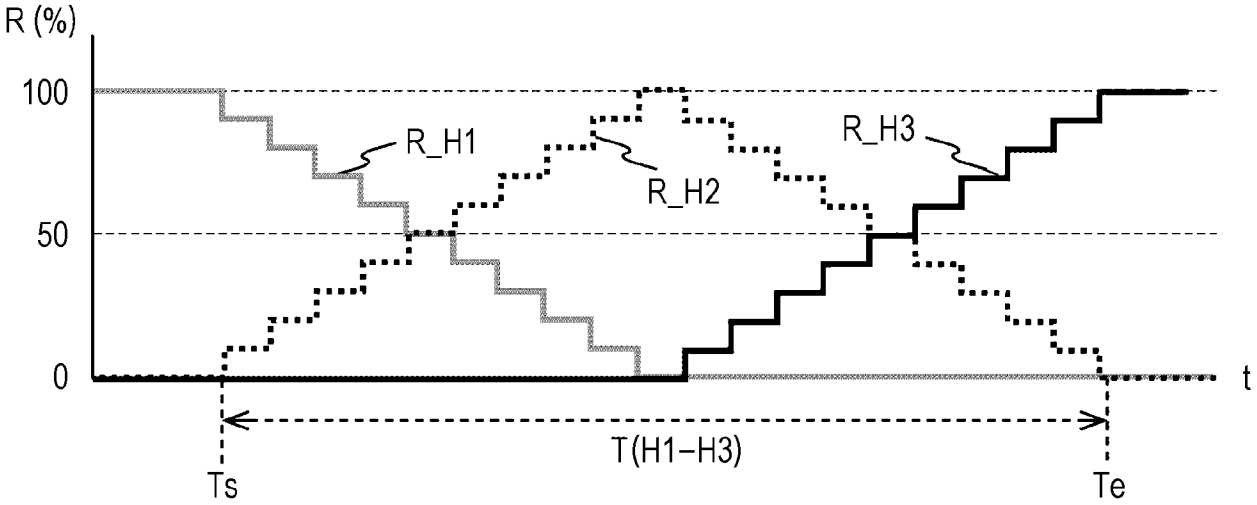
FIGS. 7A and 7B are diagrams illustrating the switching operation of the auxiliary filter according to the embodiment of the present invention.
Figure 7B:
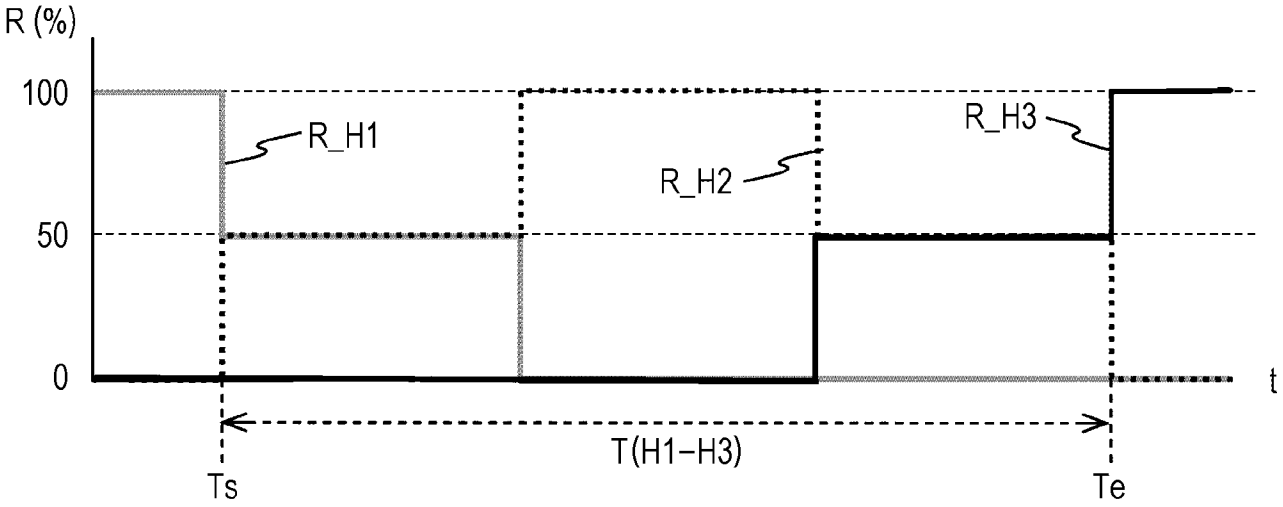

That is, for example, in the case of switching from the output of the auxiliary filter 1115 for which the transfer function H1 (z) is set to the output of the auxiliary filter 1115 for which the transfer function H3 (z) is set, as illustrated in FIG. 7A or 7B, during the transition time length T (H1-H3) from the preset transfer function H1 (z) to the transfer function H3 (z), the ratio R_H1 of the output of the auxiliary filter 1115 for which the transfer function H1 (z) input to the subtractor 1114 is set stepwise decreases from 100% to 0%, and the ratio R_H2 of the output of the auxiliary filter 1115 for which the transfer function H2 (z) input to the subtractor 1114 is set stepwise increases from 0% to 100% while satisfying R_H1+R_H2=100%, and then the ratio R_H2 of the output of the auxiliary filter 1115 for which the transfer function H2 (z) input to the subtractor 1114 is set stepwise decreases from 100% to 0% and the ratio R_H3 of the output of the auxiliary filter 1115 for which the transfer function H3 (z) input to the subtractor 1114 is set stepwise increases from 0% to 100% while satisfying R_H2+R_H3=100%, and after the lapse of T (H1-H3), the selector 1116 may perform the switching of the output so that the R_H3 is maintained at 100%.

In addition, in the above embodiment, when the position of the head detected by the position detection device 14 is between the cancellation points P1 and P2 of FIGS. 4A, 4B and 4C, or between the cancellation points P2 and P3, in the selector 1116, the outputs of the two auxiliary filters 1115 corresponding to the two cancellation points adjacent to the position of the head detected by the position detection device 14 are output to the subtractor 1114 at a ratio of the reciprocal of the distance between the corresponding cancellation point and the position of the head detected by the position detection device 14, so the virtual auxiliary filter 1115 simulating the transfer function obtained when the learning microphone 41 is arranged at the position of the head detected by the position detection device 14 to perform the learning by using the two auxiliary filters 1115 and the selector 1116 may be configured.

Figure 8A:
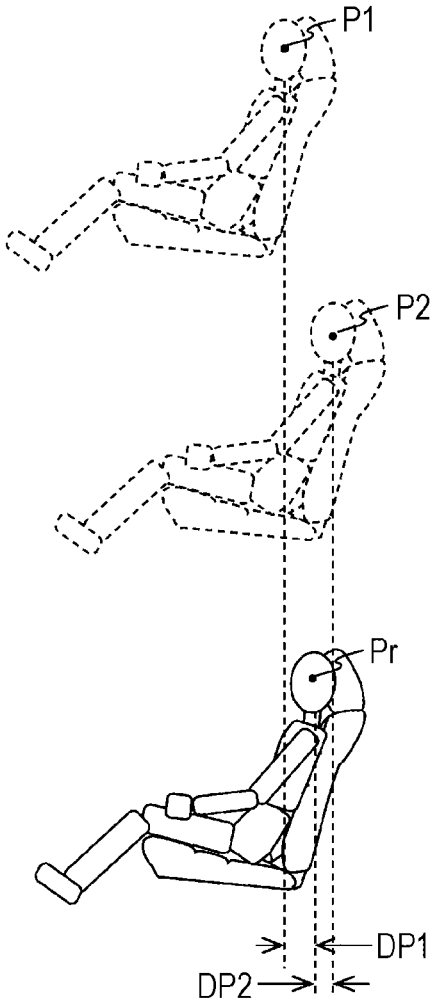

That is, for example, as illustrated in FIG. 8A, when a position Pr of the head detected by the position detection device 14 is between the cancellation points P1 and P2 and a ratio of a distance from the position Pr to the cancellation point P1 and a distance from the position Pr to the cancellation point P2 is 70:30, the state in which the ratio of the output of the auxiliary filter 1115 for which the transfer function H1 (z) corresponding to the cancellation point P1 input to the subtractor 1114 and the output of the auxiliary filter 1115 for which the transfer function H2 (z) corresponding to the cancellation point P2 input to the subtractor 1114 is set 30:70 that is the reciprocal of a distance ratio 70:30 becomes the switched state. Then, in the case where the position of the head detected by the position detection device 14 changes from the position of the cancellation point P1 to the position Pr, as illustrated in FIG. 8B1 or FIG. 8B2, in the switching control unit 112, the ratio R_H1 of the output of the auxiliary filter 1115 for which the transfer function H1 (z) input to the subtractor 1114 stepwise decreases from 100% to 30%, and the ratio R_H2 of the output of the auxiliary filter 1115 for which the transfer function H2 (z) input to the subtractor 1114 is set stepwise increases from 0% to 70% while satisfying R_H1+R_H2=100%, and then the selector 1116 performs the switching of the output so that the ratio R_H2 is maintained at 70%.

By doing so, even if the position of the head of the user is a position where the auxiliary filter 1115 that makes the position the corresponding cancellation point is not prepared, the noise heard by the user can be satisfactorily canceled using the two auxiliary filters 1115 in which the position between the corresponding cancellation points is the position of the head.

Figure 9A:
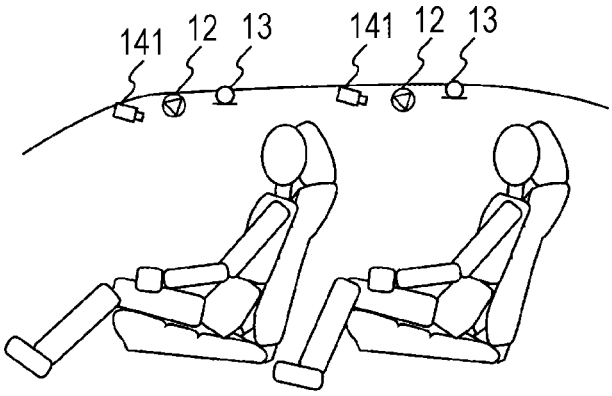
FIGS. 9A and 9B are diagrams illustrating another configuration example of the active noise control system according to the embodiment of the present invention.

In addition, in the above embodiment, the case of canceling noise for a user at one seat of the automobile has been described, but as illustrated in FIG. 9A, the speaker 12, the microphone 13, the camera 141 of the position detection device 14, and the sensor may be provided for each seat of the automobile to cancel noise for users at each seat.

Figure 9B:
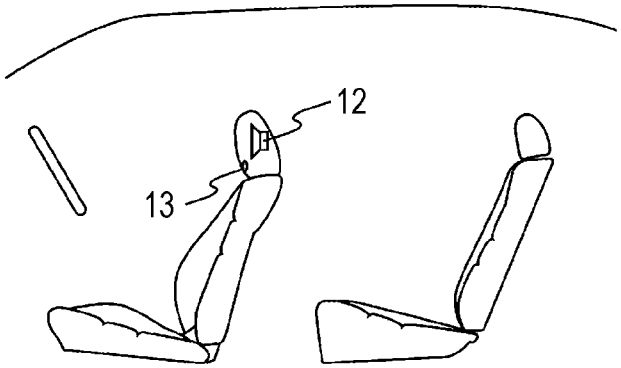

Further, in the above embodiment, the speaker 12 and the microphone 13 are provided on the ceiling in front of the target seat, but the positions of the speaker 12 and the microphone 13 may be different. That is, for example, as illustrated in FIG. 9B, the speaker 12 and the microphone 13 may be fixedly provided on the target seat.

Further, in the above embodiment, the noise signal x (n) input to the active noise control system 1 may be an audio signal output from a noise source, a voice signal in which the noise of the noise source is picked up by the noise microphone separately provided, or a signal simulating the noise of the noise source generated by a simulated sound generation device separately provided.

That is, for example, when an engine is used as a noise source, an engine sound picked up by a separate noise microphone may be a noise signal x (n), or a simulated sound simulating an engine sound generated by a simulated sound generation device separately provided may be the noise signal x (n).

Further, the above embodiment may be expanded so that positions corresponding to left and right ears of the target seat are two cancellation points and the noise at each cancellation point is canceled.

Figure 10A:
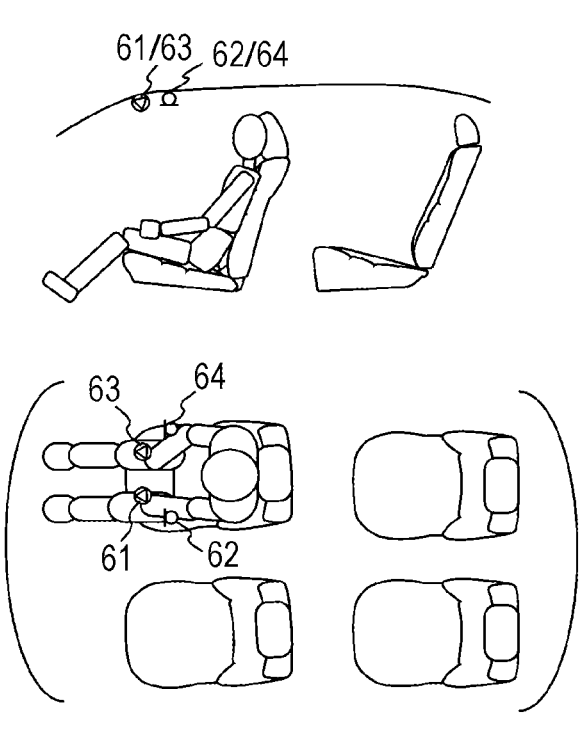
FIGS. 10A and 10B are diagrams illustrating another configuration example of the active noise control system according to the embodiment of the present invention.
Figure 10B:
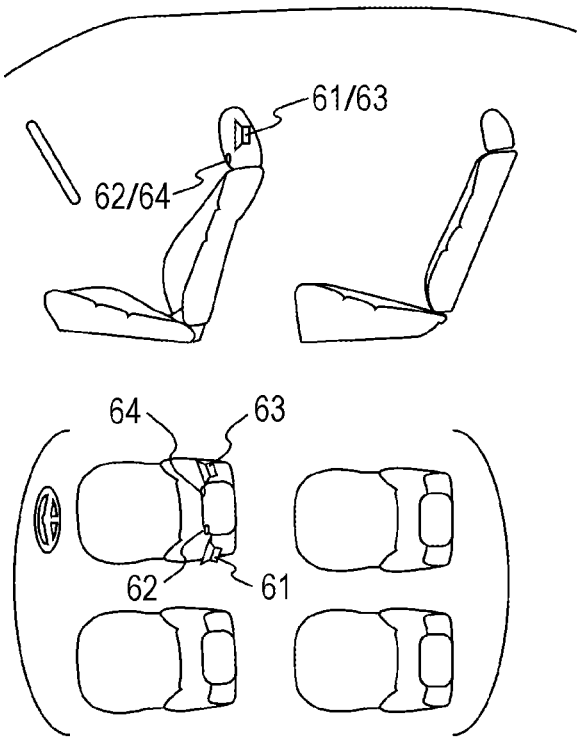
Figure 11:
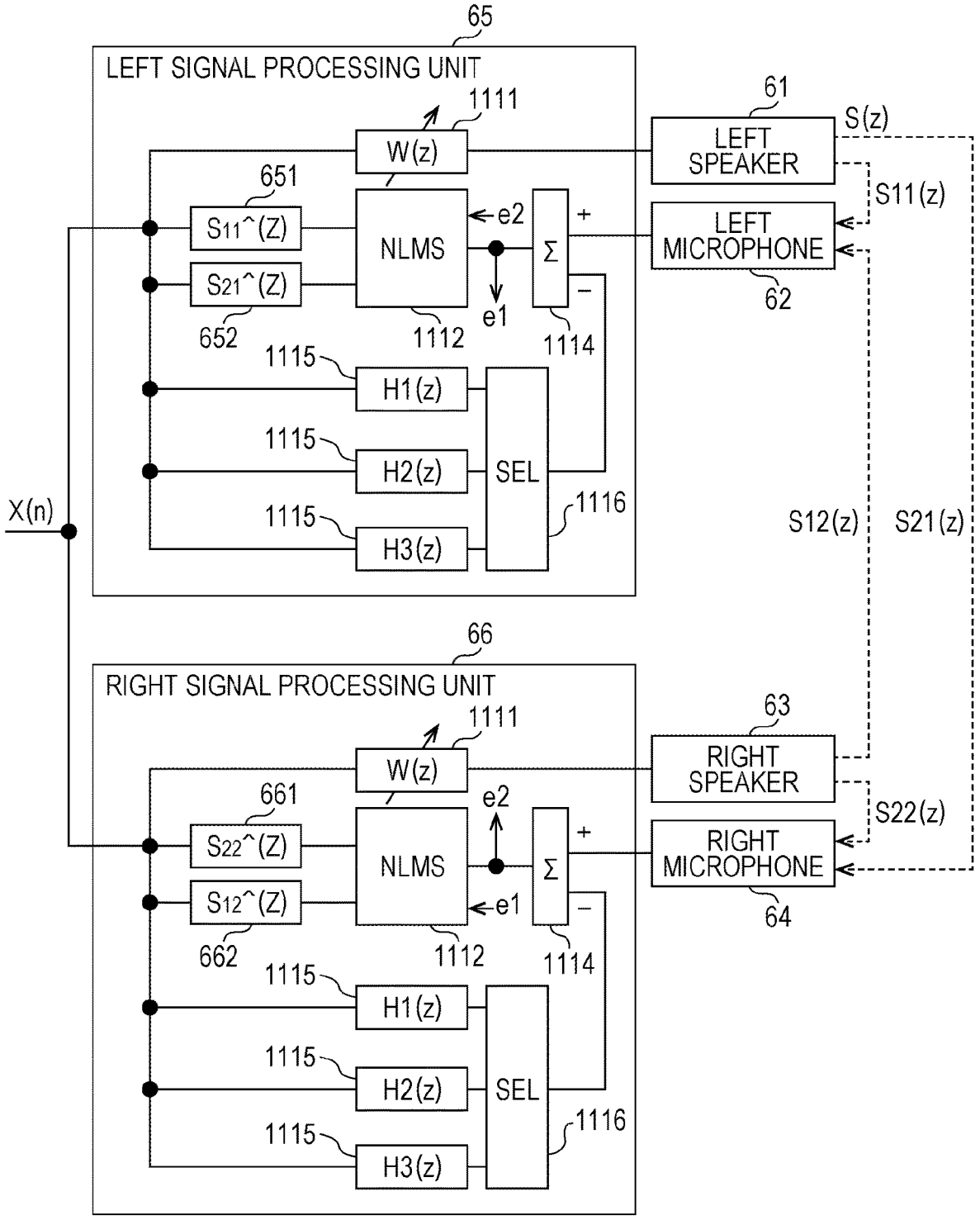
FIG. 11 is a block diagram illustrating another configuration example of the noise control device according to the embodiment of the present invention.

That is, in this case, as illustrated in FIGS. 10A and 10B, a set of a left speaker 61 and a left microphone 62 for mainly canceling noise in the left ear, and a set of a right speaker 63 and a right microphone 64 for mainly canceling noise in the right ear are provided. Then, the noise control device 11 is provided with a left signal processing unit 65 and a right signal processing unit 66 illustrated in FIG. 11, instead of the signal processing unit 111. The configuration of the left signal processing unit 65 is substantially the same as the configuration of the signal processing unit 111 illustrated in FIG. 3, but the left signal processing unit 65 is connected to the left speaker 61 instead of the speaker 12, and is connected to the left microphone 62 instead of the microphone 13.

Further, instead of the estimation filter 1113, there are provided a left first estimation filter 651 for which an estimation transfer characteristic $S_{11}\hat{}(z)$ of a transfer function $S_{11}$ (*z*) from the left signal processing unit 65 that uses the noise signal x (n) as an input and transmits an output to the adaptive algorithm execution unit 1112 to the left microphone 62 is set, and a left second estimation filter 652 for which an estimation transfer characteristic $S_{21}\hat{}(z)$ of a transfer function $S_{21}$ (*z*) from the left signal processing unit 65 to the right microphone 64 is set. In addition, an error e1 output from the subtractor 1114 and an error e2 output from the subtractor 1114 of the right signal processing unit 66 are input to the adaptive algorithm execution unit 1112, and in the adaptive algorithm execution unit 1112, a transfer function W (z) of the variable filter 1111 is updated so that the error e1 and the error e2 become 0.

In addition, the configuration of the right signal processing unit 66 is substantially the same as the configuration of the signal processing unit 111 illustrated in FIG. 3, but the left signal processing unit 65 is connected to the right speaker 63 instead of the speaker 12, and is connected to the right microphone 64 instead of the microphone 13. Further, instead of the estimation filter 1113, there are provided a right first estimation filter 661 for which an estimation transfer characteristic $S_{22}\hat{}(z)$ of a transfer function $S_{22}$ (z) from the right signal processing unit 66 that uses the noise signal x (n) as an input and transmits an output to the adaptive algorithm execution unit 1112 to the right microphone 64 is set, and a right second estimation filter 662 for which an estimation transfer characteristic $S_{12}\hat{}(z)$ of a transfer function $S_{12}$ (z) from the right signal processing unit 66 to the left microphone 62 is set. In addition, the error e2 output from the subtractor 1114 and the error e1 output from the subtractor 1114 of the left signal processing unit 65 are input to the adaptive algorithm execution unit 1112, and in the adaptive algorithm execution unit 1112, the transfer function W (z) of the variable filter 1111 is updated so that the error e1 and the error e2 become 0.

Then, in the switching control unit 112, as in the case of the signal processing unit 111 illustrated in FIG. 3, depending on the position of the head of the user of the target seat detected by the position detection device 14, the selectors 1116 of the left signal processing unit 65 and the right signal processing unit 66 select the output and switch the auxiliary filters 1115 that transmit the selected output to the subtractor 1114.

The learning of the transfer functions of each auxiliary filter 1115 of the left signal processing unit 65 and the right signal processing unit 66 are set by performing the first stage learning processing and the second stage learning processing in advance in the same manner as each auxiliary filter 1115 of the signal processing unit 111 illustrated in FIG. 3.

However, the first stage learning processing is performed using the left learning microphone and the right learning microphone instead of the learning microphone 41. Then, when learning the transfer function H1 (*z*), the left learning microphone is arranged at the typical position of the left ear of the user and the right learning microphone is arranged at the typical position of the right ear when the position of the target seat is set to be a position ahead of the standard position in the front-back direction by the distance D as illustrated in FIG. 4A, when learning the transfer function H2 (*z*), the left learning microphone is arranged at a typical position of the left ear of the user and the right learning microphone is arranged at the typical position of the right ear when the position of the target seat is set to be the standard position in the front-back direction as illustrated in FIG. 4B, and when learning the transfer function H3 (*z*), the left learning microphone is arranged at the typical position of the left ear of the user and the right learning microphone is arranged at the typical position of the right ear when the position of the target seat is set to be a position behind the standard position in the front-back direction by the distance D as illustrated in FIG. 4C.

Then, when learning the transfer function Hi (z), in the first stage learning processing, the transfer functions of the variable filters 1111 of the left signal processing unit 65 and the right signal processing unit 66 where the noise represented by the outputs of the left learning microphone and the right learning microphone 13 is eliminated are learned, in the second stage learning processing, the transfer functions of the variable filters 1111 of the left signal processing unit 65 and the right signal processing unit 66 are fixed to the transfer function in the first stage learning processing, and the transfer function of the learning auxiliary filter where the error e1 output from the subtractor 1114 of the left signal processing unit 65 and the error e2 output from the subtractor 1114 of the right signal processing unit 66 become 0 which are obtained in the state in which each auxiliary filter 1115 and selector 1116 are replaced with the learning auxiliary filter is obtained, which is the transfer function Hi (z).

Further, although the above embodiments illustrate the case where there is only one noise source 2, the above embodiments extend the configuration of the noise control device 11 to consider the propagation of each noise source 2 to each cancellation point, and as a result, can be applied even when there are a plurality of noise sources 2.

In the above signal processing unit 111, the left signal processing unit 65, and the right signal processing unit 66, the number of auxiliary filters 1115 may be three, but the number of auxiliary filters 1115 may be two or more.

While there has been illustrated and described what is at present contemplated to be preferred embodiments of the present invention, it will be understood by those skilled in the art that various changes and modifications may be made, and equivalents may be substituted for elements thereof without departing from the true scope of the invention. In addition, many modifications may be made to adapt a particular situation to the teachings of the invention without departing from the central scope thereof. Therefore, it is intended that this invention not be limited to the particular embodiments disclosed, but that the invention will include all embodiments falling within the scope of the appended claims.

What is claimed is:

1. An active noise control system for reducing noise heard by an object, the active noise control system comprising:

a microphone;

an adaptive filter that uses a noise signal representing the noise as an input;

a speaker that outputs an output of the adaptive filter as a noise cancellation sound;

a plurality of auxiliary filters that use the noise signal as an input and correspond to a plurality of different positions;

an error correction unit that corrects a microphone output signal, which is an output of the microphone, using an output of one of the auxiliary filters and outputs the corrected microphone output signal to the adaptive filter as an error signal, where the error correction unit comprises a subtractor;

a selector connected to the plurality of auxiliary filters as inputs and connected to the error correction unit as an output;

a position detection unit that detects a position of the object; and a switching control unit that, when the position of the object detected by the position detection unit changes, performs a switching operation of controlling the selector to switch the output of one of the auxiliary filters that is provided to the error correction unit before the position of the object changes to the output of an auxiliary filter for which the corresponding position matches the changed position of the object, wherein the adaptive filter executes a predetermined adaptive algorithm using an error signal input from the error correction unit and updates a transfer function of the adaptive filter, a transfer function is preset in each of the plurality of auxiliary filters as the transfer function in which the error indicated by the error signal becomes 0 when the noise is canceled by the noise cancellation sound at the corresponding position, and the switching control unit gradually or stepwise decreases a ratio at which the output of one of the auxiliary filters is provided to the error correction unit before the switching operation to 0%, and gradually or stepwise increases a ratio at which the output of one of the auxiliary filters for which the corresponding position matches the changed position of the object is provided to the error correction unit to 100%.

2. The active noise control system according to claim 1, wherein the object is a head of a user seated on a seat that is displaceable within a predetermined range, and each position where a head of a human body seated on the seat at the position is normally positioned is a position corresponding to one of the plurality of auxiliary filters, each position of the plurality of different seat positions within the displacement range being obtained.

3. The active noise control system according to claim 2, wherein a predetermined seat is a seat of an automobile.

4. An active noise control system including a first system according to claim 1 and a second system including a microphone, an adaptive filter, a speaker, a plurality of auxiliary filters, and an error correction unit as in the first system, wherein the plurality of auxiliary filters of the first system and the plurality of auxiliary filters of the second system are associated in a one-to-one correspondence, and a position relationship between a position corresponding to the auxiliary filter of the first system and a position corresponding to the auxiliary filter of the second system that are associated matches or approximates a position relationship of predetermined two positions fixed to the object, the adaptive filter of the first system and the adaptive filter of the second system execute a predetermined adaptive algorithm using an error signal output from an error correction unit of the first system and an error signal output from an error correction unit of the second system to update a transfer function of the adaptive filter, and a transfer function is preset in each of the plurality of auxiliary filters in the first and second systems as the transfer function in which the error signal output from the error correction unit of the first system and the error signal output from the error correction unit of the second system become 0 when the noise is canceled by noise cancellation sounds output from a speaker of the first system and a speaker of the second system at the position corresponding to the auxiliary filter of the first system and the position corresponding to the auxiliary filter of the second system.

5. The active noise control system according to claim 4, wherein the object is a head of a user seated on a seat that is displaceable within a predetermined range, and each position where a left ear of the human body seated on the seat at the position is normally positioned is a position corresponding to one of the plurality of auxiliary filters of the first system and each position where a right ear of the human body seated on the seat at the position is normally positioned is a position corresponding to one of the plurality of auxiliary filters of the second system, each position of the plurality of different seat positions within the displacement range being obtained, and the plurality of auxiliary filters of the first system and the plurality of auxiliary filters of the second system that are associated are the plurality of auxiliary filters of the first system and the plurality of auxiliary filters of the second system in which the position corresponding to the same seat position is obtained.

6. The active noise control system according to claim 5, wherein a predetermined seat is a seat of an automobile.

7. An active noise control system for reducing noise heard by an object, the active noise control system comprising:

a microphone;

an adaptive filter that uses a noise signal representing the noise as an input;

a speaker that outputs an output of the adaptive filter as a noise cancellation sound;

a plurality of auxiliary filters that use the noise signal as an input and correspond to a plurality of different positions;

an error correction unit that corrects a microphone output signal, which is an output of the microphone, using an output of one of the auxiliary filters and outputs the corrected microphone output signal to the adaptive filter as an error signal, where the error correction unit comprises a subtractor;

a selector connected to the plurality of auxiliary filters as inputs and connected to the error correction unit as an output;

a position detection unit that detects a position of the object; and a switching control unit that, when the position of the object detected by the position detection unit changes, performs a switching operation of controlling the selector to switch the output of an auxiliary filter that is provided to the error correction unit so that the error correction unit outputs an error signal obtained by correcting the microphone output signal using an output of a first mixture target auxiliary filter and a signal obtained by correcting the microphone output signal using an output of a second mixture target auxiliary filter at a ratio determined according to a ratio of a distance between a position corresponding to the first mixture target auxiliary filter and a position of the object and a distance between a position corresponding to the second mixture target auxiliary filter and the position of the object, using, as the first mixture target auxiliary filter and the second mixture target auxiliary filter, two auxiliary filters in which two positions corresponding to the two auxiliary filters are closest to the position of the object when the position of the object detected by the position detection unit changes, wherein the adaptive filter executes a predetermined adaptive algorithm using an error signal input from the error correction unit and updates a transfer function of the adaptive filter, and a transfer function is preset in each of the plurality of auxiliary filters as the transfer function in which the error indicated by the error signal becomes 0 when the noise is canceled by the noise cancellation sound at the corresponding position.

8. The active noise control system according to claim 7, wherein the switching control unit, in the switching operation, gradually or stepwise changes the ratio of the signal obtained by correcting the microphone output signal using the output of the first mixture target auxiliary filter and the signal obtained by correcting the microphone output signal using the output of the second mixture target auxiliary filter.

9. The active noise control system according to claim 8, wherein the object is the head of the user seated on a seat that is displaceable within a predetermined range, and each position where a head of a human body seated on the seat at the position is normally positioned is a position corresponding to one of the plurality of auxiliary filters, each position of the plurality of different seat positions within the displacement range being obtained.

10. An active noise control system including a first system according to claim 3 and a second system including a microphone, an adaptive filter, a speaker, a plurality of auxiliary filters, and an error correction unit as in the first system, wherein the plurality of auxiliary filters of the first system and the plurality of auxiliary filters of the second system are associated in a one-to-one correspondence, and a position relationship between a position corresponding to the auxiliary filter of the first system and a position corresponding to the auxiliary filter of the second system that are associated matches or approximates a position relationship of predetermined two positions fixed to the object, the adaptive filter of the first system and the adaptive filter of the second system execute a predetermined adaptive algorithm using an error signal output from the error correction unit of the first system and an error signal output from the error correction unit of the second system to update a transfer function of the adaptive filter, and a transfer function is preset in each of the plurality of auxiliary filters in the first and second systems as the transfer function in which the error signal output from the error correction unit of the first system and the error signal output from the error correction unit of the second system become 0 when the noise is canceled by noise cancellation sounds output from the speaker of the first system and the speaker of the second system at the position corresponding to the auxiliary filter of the first system and the position corresponding to the auxiliary filter of the second system.

11. The active noise control system according to claim 10, wherein the object is a head of a user seated on a seat that is displaceable within a predetermined range, and each position where a left ear of a human body seated on the seat at the position is normally positioned is a position corresponding to one of the plurality of auxiliary filters of the first system and each position where a right ear of the human body seated on the seat at the position is normally positioned is a position corresponding to one of the plurality of auxiliary filters of the second system, each position of the plurality of different seat positions within the displacement range being obtained, and the plurality of auxiliary filters of the first system and the plurality of auxiliary filters of the second system that are associated are the plurality of auxiliary filters of the first system and the plurality of auxiliary filters of the second system in which the positions corresponding to the same seat position is obtained.

12. The active noise control system according to claim 11, wherein a predetermined seat is a seat of an automobile.

13. The active noise control system according to claim 7, wherein the object is the head of the user seated on a seat that is displaceable within a predetermined range, and each position where a head of a human body seated on the seat at the position is normally positioned is a position corresponding to one of the plurality of auxiliary filters, each position of the plurality of different seat positions within the displacement range being obtained.

14. The active noise control system according to claim 13, wherein a predetermined seat is a seat of an automobile.

15. An active noise control method for reducing noise heard by an object, the active noise control method comprising:

using an error correction unit comprising a subtractor, correcting a microphone output signal using an output of one of a plurality of auxiliary filters that correspond to a plurality of different positions and use a noise signal representing the noise as an input, where a selector is connected to the plurality of auxiliary filters as inputs and connected to the error correction unit as an output, and outputting the corrected microphone output signal to an adaptive filter as an error signal, where the adaptive filter uses the noise signal representing the noise as an input;

outputting from a speaker an output of the adaptive filter as a noise cancellation sound;

detecting a position of the object; and when the detected position of the object changes, controlling the selector to switching the output of one of the auxiliary filters that is provided before the position of the object changes to the output of an auxiliary filter for which the corresponding position matches the changed position of the object, wherein the adaptive filter executes a predetermined adaptive algorithm using the error signal and updates a transfer function of the adaptive filter, a transfer function is preset in each of the plurality of auxiliary filters as the transfer function in which the error indicated by the error signal becomes 0 when the noise is canceled by the noise cancellation sound at the corresponding position, and the switching operation gradually or stepwise decreases a ratio at which the output of one of the auxiliary filters is provided before the position of the object changes to 0%, and gradually or stepwise increases a ratio at which the output of one of the auxiliary filters for which the corresponding position matches the changed position of the object to 100%.

16. The active noise control method according to claim 15, wherein the object is a head of a user seated on a seat that is displaceable within a predetermined range, and each position where a head of a human body seated on the seat at the position is normally positioned is a position corresponding to one of the plurality of auxiliary filters, each position of the plurality of different seat positions within the displacement range being obtained.

17. The active noise control method according to claim 16, wherein the seat is a seat of an automobile.

* * * * *